US006963260B2

(12) United States Patent
Germain et al.

(10) Patent No.: US 6,963,260 B2
(45) Date of Patent: Nov. 8, 2005

(54) GFCI RECEPTACLE HAVING BLOCKING MEANS

(75) Inventors: Frantz Germain, Rosedale, NY (US); Stephen Stewart, Berrien Springs, MI (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 10/757,743

(22) Filed: Jan. 15, 2004

(65) Prior Publication Data

US 2005/0013066 A1 Jan. 20, 2005

Related U.S. Application Data

(60) Provisional application No. 60/444,573, filed on Feb. 3, 2003.

(51) Int. Cl.[7] ..... H01H 73/00
(52) U.S. Cl. ..... 335/18; 361/42
(58) Field of Search ..... 335/18, 202, 165–176; 361/42–51

(56) References Cited

U.S. PATENT DOCUMENTS 5,694,280 A 12/1997 Zhou
5,933,063 A 8/1999 Keung et al.
6,437,953 B2 * 8/2002 DiSalvo et al. ..... 361/42
6,734,769 B1 * 5/2004 Germain et al. ..... 335/6
2004/0125519 A1 * 7/2004 Germain et al. ..... 361/42

FOREIGN PATENT DOCUMENTS

WO WO 2004/070906 8/2004

* cited by examiner

*Primary Examiner*—Lincoln Donovan
(74) *Attorney, Agent, or Firm*—Paul J. Sutton

(57) ABSTRACT

Located within a GFCI device having receptacle openings in its face is a movable contact bearing arm held in either a closed or open position by a latching member connected to a spring loaded reset button. The reset button assumes a first depressed position when the GFCI is in a conducting state, and a second extended position when the GFCI is in a non conducting state. A blocking member located within the body of the GFCI is adapted to be moved to a first position to blocks at least one opening of each receptacle, or to a second position to allow the prongs of a plug to enter the receptacle openings. When the GFCI is in the conducting state, the reset button is in its first position and holds the blocking member in its first position to permit the prongs of a plug to be inserted into the receptacle openings. When the GFCI is in a non-conducting state or is defective, the reset button and the blocking member are in their second positions and the prongs of a plug are prevented from entering the receptacle.

11 Claims, 8 Drawing Sheets

10
12
14
16
18
20
21
22
24
26
28
30
32
34
36
RESET
TEST

GFCI RECEPTACLE HAVING BLOCKING MEANS

CROSS-REFERENCE TO RELATED APPLICATIONS

This application claims priority pursuant to 35 U.S.C 119(e) from U.S. Provisional Patent Application having application No. 60/444,573, filed Feb. 3, 2003.

BACKGROUND OF THE INVENTION

1. Field of the Invention

The present invention relates generally to resettable circuit interrupting devices and systems and more particularly to a ground fault circuit interrupter (GFCI) protected receptacle having plug blocking means.

2. Description of the Related Art

Many electrical wiring devices have a line side, which is connectable to an electrical power supply, a load side which is connectable to one or more loads and at least one conductive path between the line and load sides. Electrical connections to wires supplying electrical power or wires conducting electricity to one or more loads can be at the line side and load side connections. The electrical wiring device industry has witnessed an increasing call for circuit breaking devices or systems which are designed to interrupt power to various loads, such as household appliances, consumer electrical products and branch circuits. In particular, electrical codes require electrical circuits in home bathrooms and kitchens to be equipped with ground fault circuit interrupters (GFCI). Presently available GFCI devices, such as the device described in commonly owned U.S. Pat. No. 4,595,894 ('894), use an electrically activated trip mechanism to mechanically break an electrical connection between the line side and the load side. Such devices are resettable after they are tripped by, for example, detection of a ground fault. In the device disclosed in the '894 patent, the trip mechanism used to cause the mechanical breaking of the circuit (i.e., the conductive path between the line and load sides) includes a solenoid (or trip coil). A test button is used to test the trip mechanism and circuitry is provided to sense faults. A reset button is provided to reset the electrical connection between the line and load sides.

However, instances may arise where an abnormal condition such as a lightning strike may result not only in a surge of electricity at the device and a tripping of the device, but also the disabling of the trip mechanism used to cause the mechanical breaking of the circuit. This can occur without the knowledge of the user. Under such circumstances an unknowing user, faced with a GFCI which has tripped, may press the reset button which, in turn, will cause the device with an inoperative trip mechanism to be reset without the ground fault protection being available.

Further, an open neutral condition, which is defined in Underwriters Laboratories (UL) Standard PAG 943A, may exist with the electrical wires supplying electrical power to such GFCI devices. If an open neutral condition exists with the neutral wire on the line (versus load) side of the GFCI device, an instance may arise where a current path is created from the phase (or hot) wire supplying power to the GFCI device through the load side of the device and a person to ground. In the event that an open neutral condition exists, a GFCI device which has tripped, may be reset even though the open neutral condition may remain.

Commonly owned U.S. Pat. No. 6,040,967, which is incorporated herein in its entirety by reference, describes a family of resettable circuit interrupting devices capable of locking out the reset portion of the device if the circuit interrupting portion is non-operational or if an open neutral condition exists. Circuit interrupting devices normally have a user accessible load side connection such as a GFCI protected receptacle in addition to line and load side connections such as binding screws. The user accessible load side connected receptacle can be used to connect an appliance such as a toaster or the like to electrical power supplied from the line side. The load side connection and the receptacle are typically electrically connected together. As noted, such devices are connected to external wiring so that line wires are connected to the line side connection and load side wires are connected to the load side connection. However, instances may occur where the circuit interrupting device is improperly connected to the external wires so that the load wires are connected to the line side connection and the line wires are connected to the load connection. This is known as reverse wiring. Such wiring is prevalent in new construction, where power is not yet provided to the residence branch circuits and the electrician has difficulty in distinguishing between the line side and load side conductors. In the event the circuit interrupting device is reverse wired, the user accessible load connection may not be protected, even if fault protection to the load side connection remains.

A resettable circuit interrupting device, such as a GFCI device, that includes reverse wiring protection, and optionally an independent trip portion and/or a reset lockout portion is disclosed in U.S. Pat. No. 6,246,558, ('558) assigned to the same assignee as this invention and incorporated in its entirety herein by reference. Patent '558 utilizes bridge contacts located within the GFCI to isolate the conductors to the receptacle contacts from the conductors to the load if the line side wiring to the GFCI is improperly connected to the load side when the GFCI is in a tripped state. The trip portion operates independently of the circuit interrupting portion used to break the electrical continuity in one or more conductive paths in the device. The reset lockout portion prevents reestablishing electrical continuity of an open conductive path if the circuit interrupting portion is not operational or if an open neutral condition exists.

While the breaking of the electrical circuit and the utilization of bridge contacts provides electrical isolation protection between the load conductors and the receptacle contacts when the GFCI is in a tripped state, blocking means which can prevent a plug from being inserted into the receptacle of a GFCI when the GFCI is in a fault state, either with or without the bridge contacts and/or the reset lockout is desired to provide user safety.

SUMMARY OF THE INVENTION

In one embodiment, the circuit interrupting device such as a GFCI includes phase and neutral conductive paths disposed at least partially within a housing between the line and load sides. The phase conductive path terminates at a first connection capable of being electrically connected to a source of electricity, a second connection capable of conducting electricity to at least one load and a third connection capable of conducting electricity to at least one user accessible load through a receptacle. Similarly, the neutral conductive path terminates at a first connection capable of being electrically connected to a source of electricity, a second connection capable of providing a neutral connection to the at least one load and a third connection capable of providing a neutral connection to the at least one user accessible load through the receptacle. The first and second connections can be screw terminals.

The GFCI also includes a circuit interrupting portion disposed within the housing and configured to cause electrical discontinuity in one or both of the phase and neutral conductive paths between the line side and the load side upon the occurrence of a predetermined condition. A reset portion activated by depressing a spring loaded reset button disposed at least partially within the housing is configured to reestablish electrical continuity in the open conductive paths. The reset button assumes a first or a second position which is determined by the conductive state of the GFCI. When the GFCI is in a conducting state, the reset button assumes a position that is substantially fully depressed within the housing of the GFCI, here referred to as a first position. When the GFCI is in a non-conducting state, the reset button projects outward beyond the top surface of the housing of the GFCI, here referred to as the second position.

The GFCI may also includes a reset lockout that prevents reestablishing electrical continuity in either the phase or neutral conductive path, or both conductive paths if the circuit interrupting portion is not operating properly. Depression of the reset button when in its second position causes at least a portion of the phase conductive path to contact at least one reset contact. When contact is made between the phase conductive path and the at least one reset contact, the circuit interrupting portion is activated to disable the reset lockout portion and reestablish electrical continuity in the phase and neutral conductive paths.

The GFCI also includes a trip portion that operates independently of the circuit interrupting portion. The trip portion is disposed at least partially within the housing and is configured to cause electrical discontinuity in the phase and/or neutral conductive paths independently of the operation of the circuit interrupting portion. The trip portion includes a trip actuator, such as a button, accessible from the exterior of the housing and a trip arm preferably within the housing which extends from the trip actuator. The trip arm is configured to facilitate the mechanical breaking of electrical continuity in the phase and/or neutral conductive paths when the trip actuator is actuated.

Located within a GFCI device having a receptacle is a movable contact bearing arm which is held in either a closed or open position with a fixed contact by a latching member that is connected to the spring loaded reset button. The reset button assumes a first or a second position which is determined by the conductive state of the GFCI. When the GFCI is in a conducting state, the reset button is substantially fully depressed within the housing of the GFCI. When the GFCI is in a non-conductive state, the reset button projects outward beyond the top surface of the housing of the GFCI. Thus, the movable contact bearing arm, acting through a latching member, determines the position of the reset button. A receptacle blocking member located within the body of the GFCI is positioned in part by the reset button to allow free access of the prongs of a plug into the openings of the receptacle when the reset button is depressed or to block at least one opening of the receptacle to prevent a plug from entering the openings of the receptacle when the reset button projects out beyond the surface of the housing. Thus, when the GFCI is in a conducting state, the reset button is recessed within the GFCI housing and positions the blocking member to the first position to allow the prongs of a plug to be inserted into the receptacle openings. When the GFCI is in a non-conducting state, the reset button protrudes outward from the housing of the GFCI to allow the blocking member to be positioned to the second position to block at least one opening of the receptacle to prevent the prongs of a plug from entering the receptacle. GFCI's normally have two separate sets of internally located contacts known as bridge contacts where one set is used to connect a load to the source of electricity and the second set is used to connect a user accessible load to the source of electricity. The bridge contacts provide isolation between the conductors to the load and the conductors to the contacts of the GFCI receptacle when the GFCI is in a fault state. In the GFCI here disclosed, the blocking member can prevent the prongs of a plug from entering the receptacle when the GFCI is in a fault state and, therefore, in some circumstances, the need for the bridge contacts may not be necessary.

BRIEF DESCRIPTION OF THE DRAWINGS

Preferred embodiments of the present application are described herein with reference to the drawings in which similar elements are given similar reference characters, wherein.

DETAILED DESCRIPTION

Figure 1:
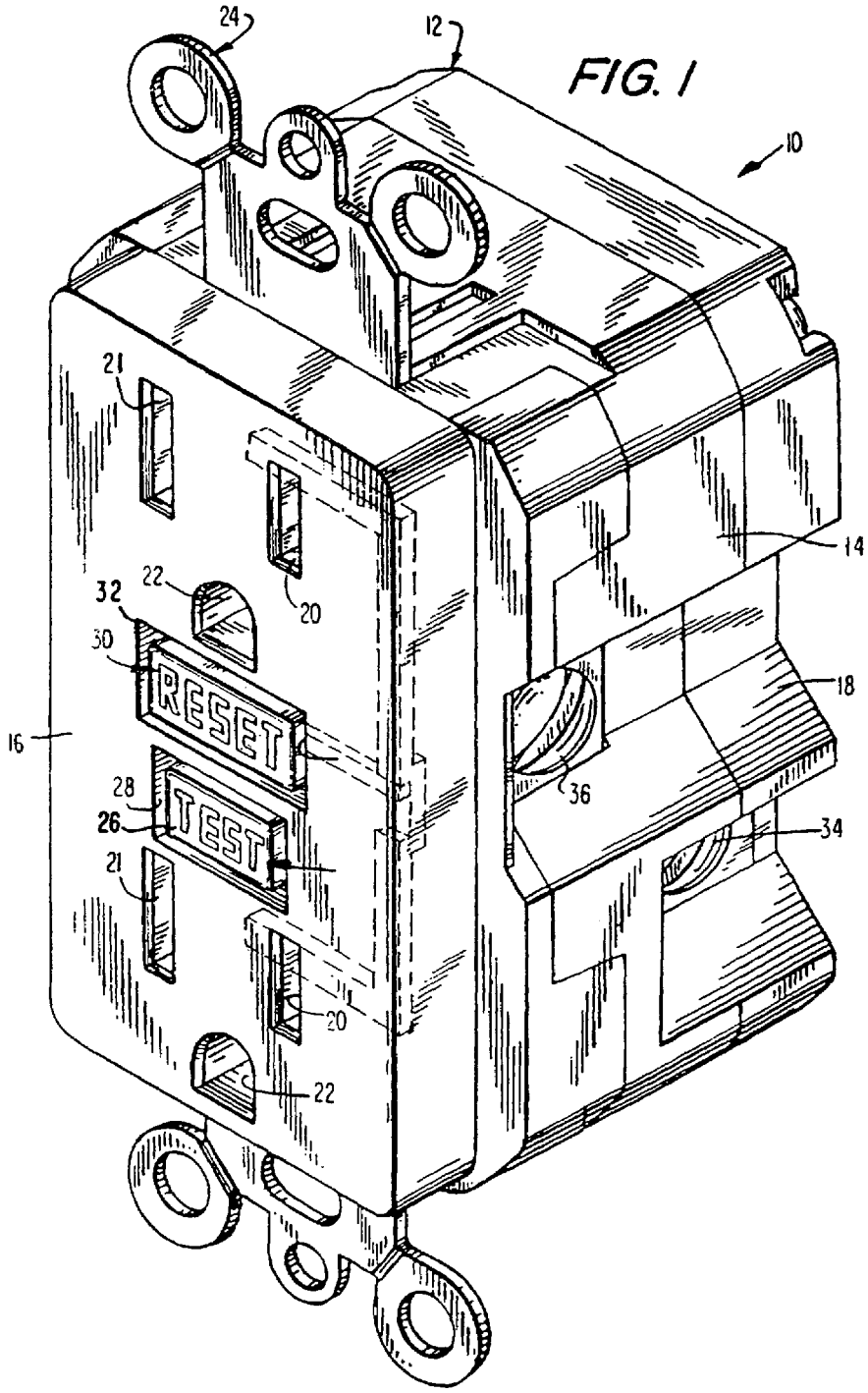
FIG. 1 is a perspective view of an embodiment of a prior art ground fault circuit interrupting (GFCI) device illustrating in dotted outline the blocking member of the invention disclosed.

The present application contemplates various types of circuit interrupting devices that are capable of breaking at least one conductive path at both a line side and a load side of the device. The conductive path is typically divided between a line side that connects to supplied electrical power and a load side that connects to one or more loads. The term resettable circuit interrupting devices include ground fault circuit interrupters (GFCI's), arc fault circuit interrupters (AFCI's), immersion detection circuit interrupters (IDCI's), appliances leakage circuit interrupters (ALCI's), and equipment leakage circuit interrupters (ELCI's) which have a receptacle for receiving a plug.

For the purpose of the present application, the structure or mechanisms used in the circuit interrupting devices, shown in the drawings and described below, are incorporated into a GFCI protected receptacle which can receive at least one plug and is suitable for installation in a single gang junction box used in, for example, a residential electrical wiring system. However, the mechanisms according to the present application can be included in any of the various resettable circuit interrupting devices.

The GFCI receptacle described herein has line and load phase (or power) connectors, line and load neutral connectors and a plug receiving receptacle to provide user accessible load phase and neutral connections. These connectors can be, for example, electrical fastening devices that secure or connect external conductors to the circuit interrupting device. Examples of such connectors can include binding screws, lugs, terminals and external plug connections.

In the embodiment, the GFCI receptacle has a circuit interrupting portion, a reset portion and, if desired, a reset lockout and/or bridge contacts in combination with a blocking member to prevent the prongs of a plug from entering the receptacle when the GFCI is in a fault or non-conducting state. The circuit interrupting and reset portions described herein use electromechanical components to break (open) and make (close) one or more conductive paths between the line and load sides of the device. However, electrical components such as solid state switches and supporting circuitry, may be used to open and close the conductive paths.

Generally, the circuit interrupting portion is used to automatically break electrical continuity in one or more conductive paths (i.e. open the conductive path) between the line and load sides upon the detection of a fault. The reset button is used to close the open conductive paths. The operation and positioning of the blocking member to prevent the prongs of a plug from entering the openings in the receptacle when a fault is detected is determined by the position of the reset button and the interrupting and reset portions. A movable arm supporting at least one of the contacts between the line side and the load side, acting through a latching member, determines the position of the reset button. The reset button is used to disable the reset lockout, close the open conductive paths and reset the blocking member to its open position to permit a plug to be inserted into the receptacle. The reset button and reset lockout portions operate in conjunction with the operation of the circuit interrupting portion, so that electrical continuity cannot be reestablished and the blocking member continues to block at least one opening of the receptacle to prevent the prongs of a plug from entering the receptacle when the circuit interrupting portion is not operational, when an open neutral condition exists and/or the device is reverse wired.

The above described structure of a blocking member to selectively block at least one opening of the receptacle can be incorporated in any resettable circuit interrupting device, but for explanation purposes, the description herein is directed to GFCI receptacles.

Figure 2:
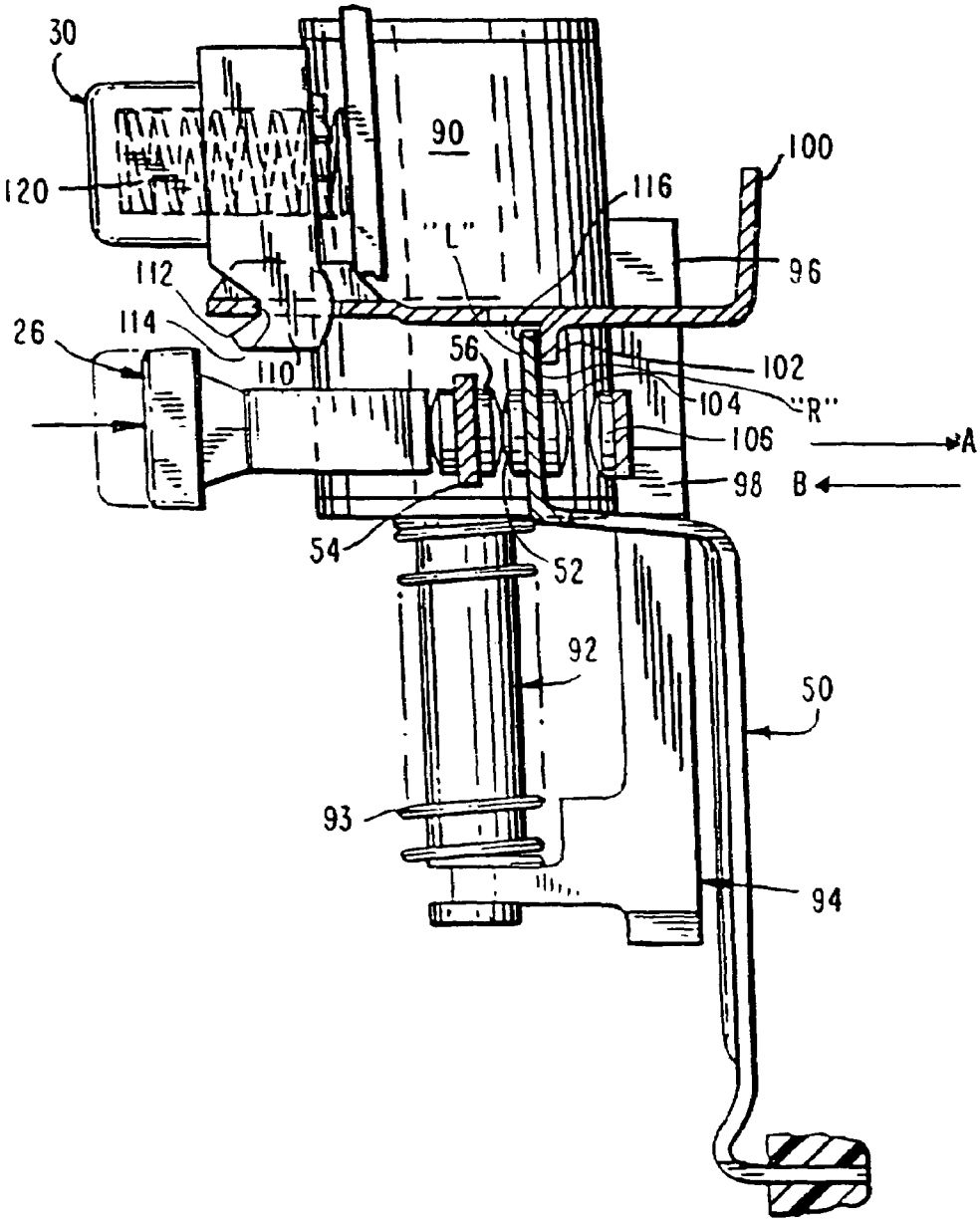
FIG. 2 is a side elevation view, partially in section, of a portion of the GFCI device shown in FIG. 1, illustrating the GFCI device in a conducting state.
Figure 3:
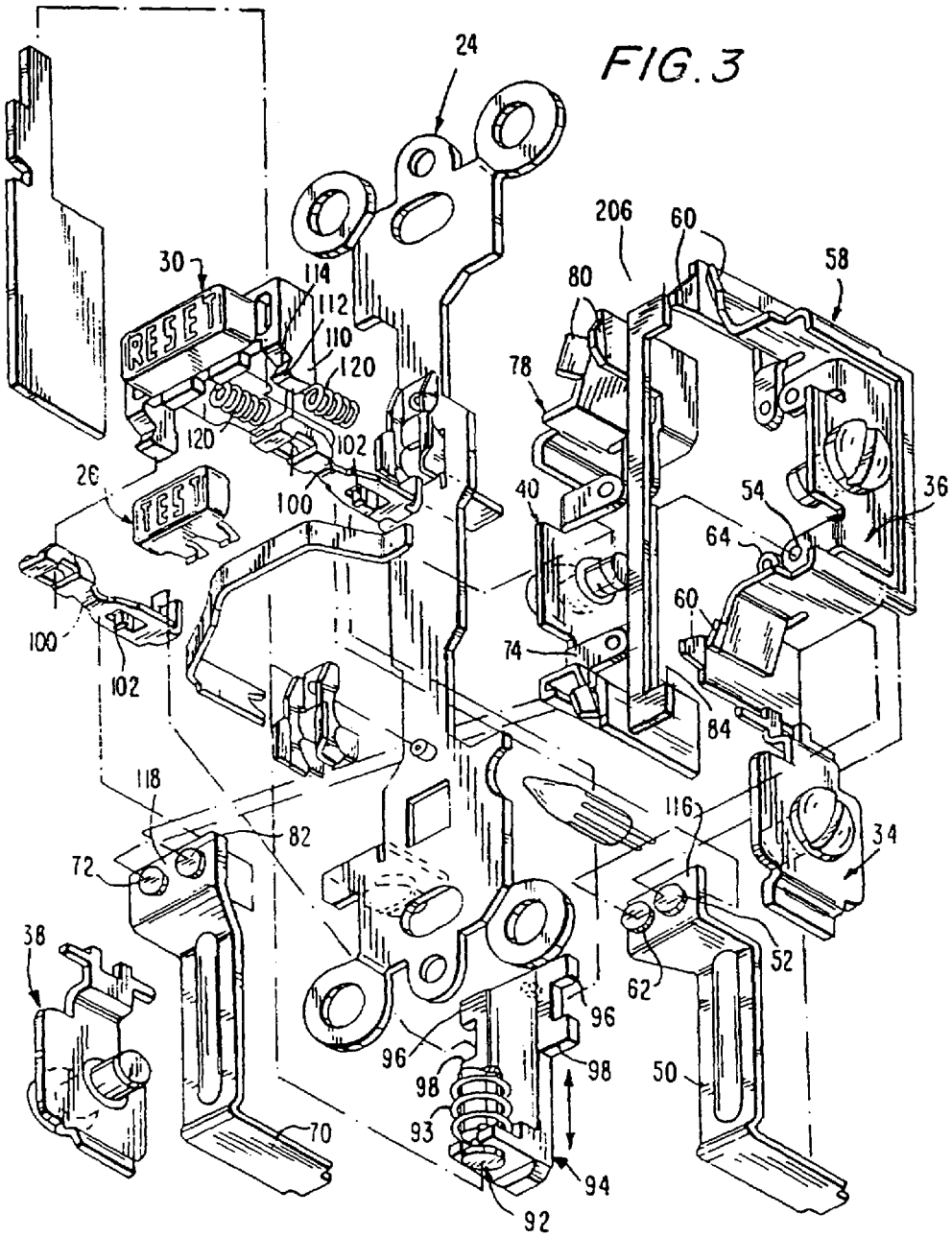
FIG. 3 is an exploded view of internal components of the prior art GFCI device of FIG. 1.
Figure 4:
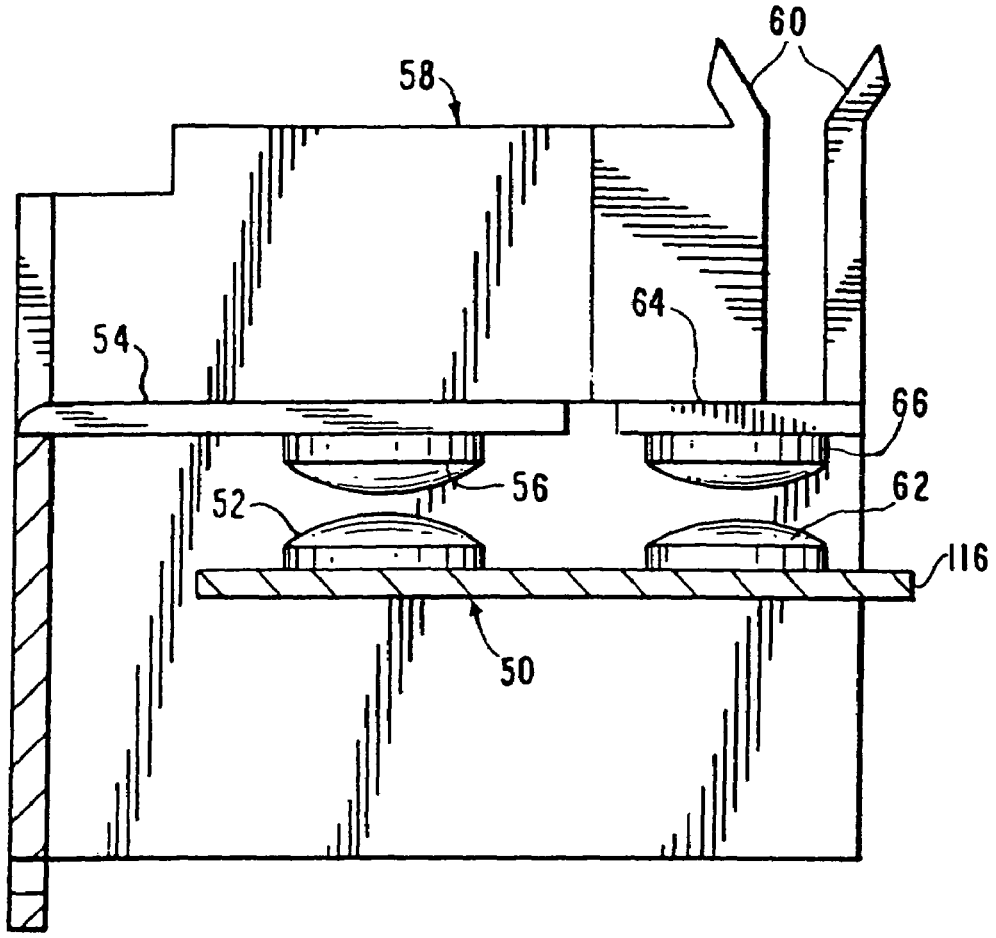
FIG. 4 is a partial sectional view of a portion of a conductive path shown in FIG. 3

FIGS. 1, 2 and 3 are of a GFCI device such as is disclosed in commonly owned U.S. Pat. No. 6,246,558, which is incorporated in its entirety herein by reference, and where portions of which are here included to provide a full and complete understanding of the invention here disclosed. Turning to FIG. 1, the GFCI receptacle 10 has a housing 12 consisting of a central body 14 to which a face or cover portion 16 and a rear portion 18 are removably secured. The face portion 16 has entry ports 20 and 21 for receiving normal or polarized prongs of a male plug of the type normally found at the end of a lamp or appliance cord set, as well as ground prong receiving openings 22 to accommodate a three wire plug. The receptacle also includes a mounting strap 24 used to fasten the receptacle to a junction box.

A test button 26 which extends through opening 28 in the face portion 16 of the housing 12 is used to activate a test operation, that tests the operation of the circuit interrupting portion (or circuit interrupter) disposed in the device. The circuit interrupting portion is used to break electrical continuity in one or more conductive paths between the line and load side of the device. A reset button 30 forming a part of the reset portion extends through opening 32 in the face portion 16 of the housing 12. The reset button is used to activate a reset operation, which reestablishes electrical continuity to open conductive paths. Electrical connections to existing household electrical wiring are made via binding screws 34 and 36, where screw 34 is an input or line phase connection, and screw 36 is an output or load phase connection. Two additional binding screws 38 and 40 (see FIG. 3) are located on the opposite side of the receptacle 10. These additional binding screws provide line and load neutral connections, respectively. A more detailed description of a GFCI receptacle is provided in U.S. Pat. No. 4,595,894, which is incorporated herein in its entirety by reference. Binding screws 34, 36, 38 and 40 are exemplary of the types of wiring terminals that can be used to provide the electrical connections. Examples of other types of wiring terminals include set screws, pressure clamps, pressure plates, push-in type connections, pigtails and quick connect tabs.

Referring to FIG. 2, the conductive path between the line phase connector 34 and the load phase connector 36 includes contact arm 50 which is movable between a stressed and an unstressed position, contact 52 mounted to movable contact arm 50, contact arm 54 secured to or monolithically formed into the load phase connection 36 and fixed contact 56 mounted to the contact arm 54. The user accessible load phase connection for this embodiment includes terminal assembly 58 (see FIG. 3) having two binding terminals 60 which are capable of engaging a prong of a male plug inserted there between. The conductive path between the line phase connection 34 and the user accessible load phase connection includes contact arm 50, movable contact 62 mounted to contact arm 50, contact arm 64 secured to or monolithically formed into terminal assembly 58, and fixed contact 66 mounted to contact arm 64. These conductive paths are collectively called the phase conductive path.

Similar to the above, the conductive path between the line neutral connector 38 and the load neutral connector 40 includes contact arm 70 which is movable between a stressed and an unstressed position, movable contact 72 mounted to contact arm 70, contact arm 74 secured to or monolithically formed into load neutral connection 40, and fixed contact 76 mounted to contact arm 74. The user accessible load neutral connection for this embodiment includes terminal assembly 78 having two binding terminals 80 which are capable of engaging a prong of a male plug inserted there between. The conductive path between the line neutral connector 38 and the user accessible load neutral connector includes contact arm 70, contact arm 84 secured to or monolithically formed into terminal assembly 78, and fixed contact 86 mounted to contact arm 84. These conductive paths are collectively called the neutral conductive path.

Figure 5:
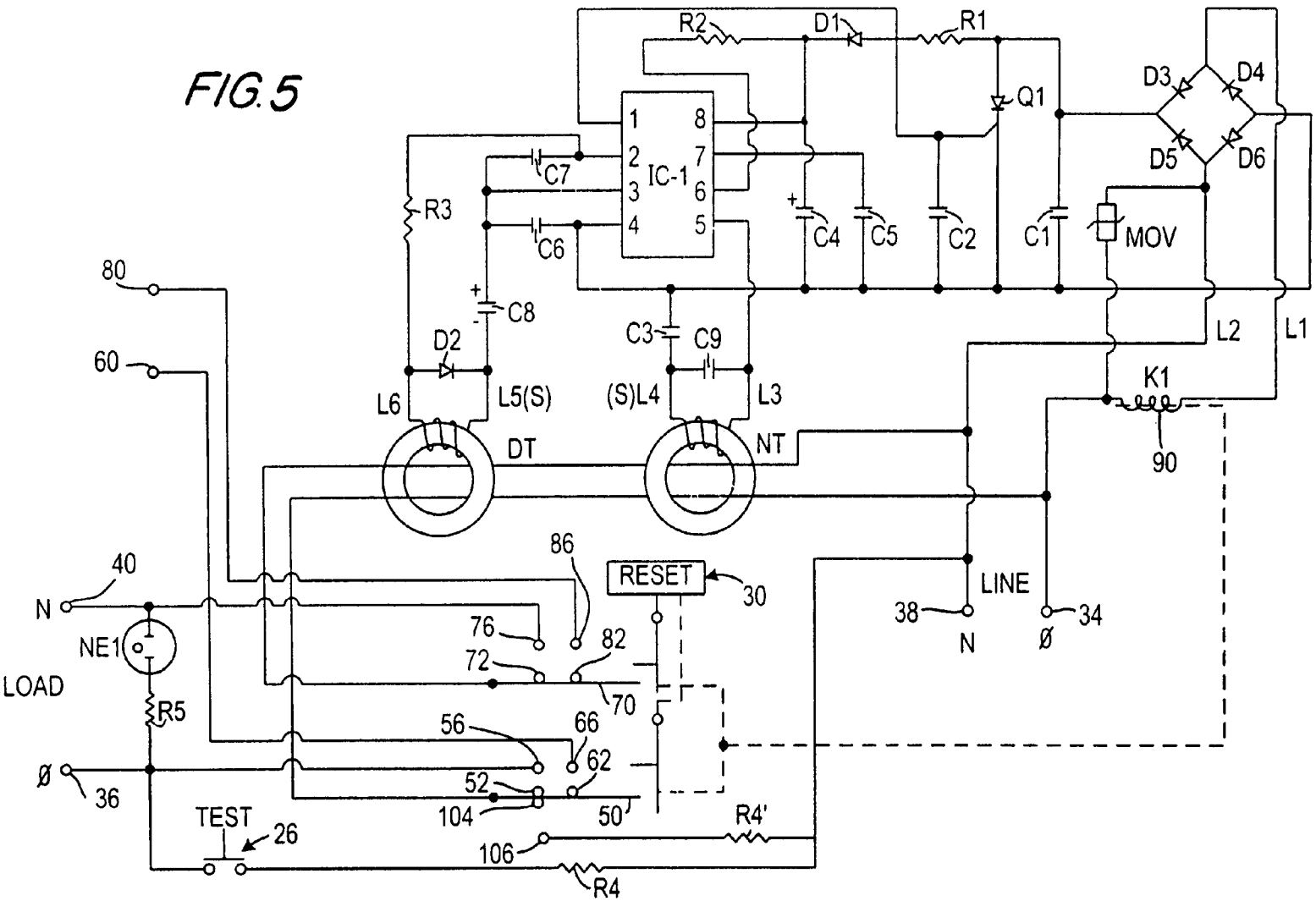
FIG. 5 is a schematic diagram of the circuit of the GFCI device of FIG. 1.
Figure 6:
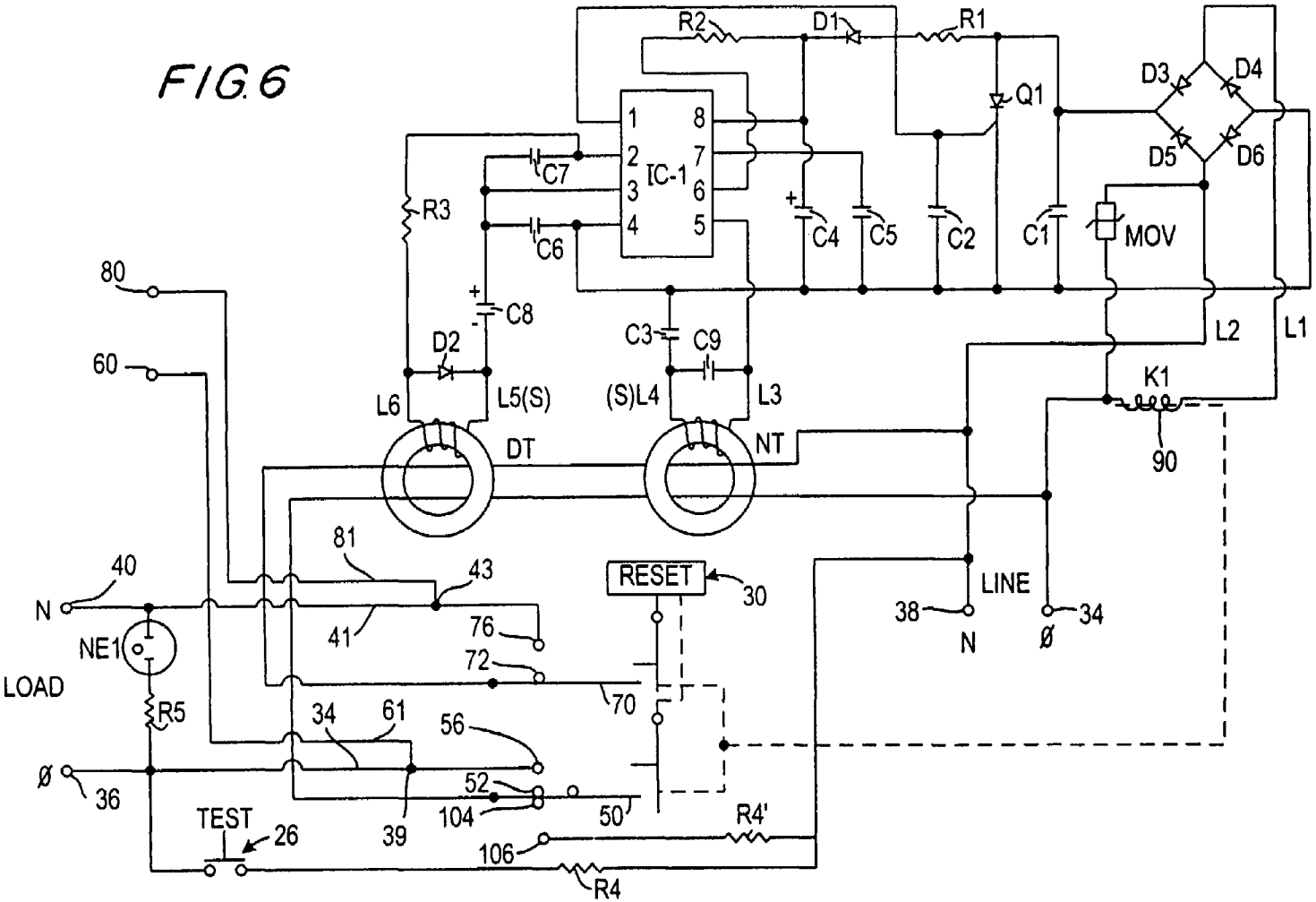
FIG. 6 is a schematic diagram of a GFCI device of FIG. 1 without bridge contacts.

Continuing with FIG. 2, the circuit interrupting portion has a circuit interrupter and electronic circuitry capable of sensing faults, e.g., current imbalances, on the hot and/or neutral conductors. In an embodiment of the GFCI receptacle, the circuit interrupter includes a coil assembly 90, a plunger 92 responsive to the energizing and de-energizing of the coil assembly and a banger 94 connected to the plunger 92. The banger 94 has a pair of banger dogs 96 and 98 which interact with movable latching members 100 used to set and reset electrical continuity in one or more conductive paths. The coil assembly 90 is activated in response to the sensing of a ground fault by, for example, the sense circuitry shown in FIG. 5 that includes a differential transformer that senses current imbalances.

The reset portion includes reset button 30, movable latching members 100 connected to the reset button 30, latching fingers 102 and normally open momentary reset contacts 104 and 106 that temporarily activate the circuit interrupting portion when the reset button is depressed, when in the tripped position. The latching fingers 102 are used to engage side R of each contact arm 50, 70 and move the arms 50, 70 back to the stressed position where contacts 52, 62 touch contacts 56, 66 respectively, and where contacts 72, 82 touch contacts 76, 86 respectively. At this time the GFCI is in its conducting state and the reset button 30 is in the first position, that being where the top surface of the button is substantially flush with the top surface of the GFCI. As can be seen in FIG. 2, the engagement of latching finger with the bottom surface of movable member 50 limits the upward movement of reset button to be substantially flush with the top surface of the GFCI.

The movable latching members 100 can be common to each portion (i.e., the circuit interrupting, reset and reset lockout portions) and used to facilitate making, breaking or locking out of electrical continuity of one or more of the conductive paths. However, the circuit interrupting devices according to the present application also contemplate embodiments where there is no common mechanism or member between each portion or between certain portions. Further, the present application also contemplates using circuit interrupting devices that have circuit interrupting, reset and reset lockout portions to facilitate making, breaking or locking out of the electrical continuity of one or both of the phase or neutral conductive paths.

In the embodiment shown in FIGS. 2 and 3, the reset lockout portion includes latching fingers 102 which, after the device is tripped, engages side L of the movable arms 50, 70 so as to block the movable arms 50, 70 from moving. By blocking movement of the movable arms 50, 70; contacts 52 and 56, contacts 62 and 66, contacts 72 and 76, and contacts 82 and 86 are prevented from touching. Alternatively, only one of the movable arms 50 or 70 may be blocked so that their respective contacts are prevented from touching. Further, latching fingers 102 act as an active inhibitor to prevent the contacts from touching. Alternatively, the natural bias of movable arms 50 and 70 can be used as a passive inhibitor that prevents the contacts from touching. As just noted, after the device is tripped and is in its non-conducting state, the latching finger 102 is located above the top side of the movable member 50 and does not engage movable member 50. Thus, latching member 100 is free to move to its uppermost position to position the reset button to the second position, that being where the top of the reset button projects beyond the top surface of the GFCI.

Thus, when the device is in the conducting state, the top of the reset button is substantially flush with the top surface of the device; and, when the device is in the non-conducting state, the top of the reset button is at a new position which is above the top surface of the device.

Referring to FIG. 2, the GFCI receptacle is shown in a set position where movable contact arm 50 is in a stressed condition so that movable contact 52 is in electrical engagement with fixed contact 56 of contact arm 54. If the sensing circuitry of the GFCI receptacle senses a ground fault, the coil assembly 90 is energized to draw plunger 92 into the coil assembly 90 and banger 94 moves upwardly. As the banger moves upward, the banger front dog 98 strikes the latch member 100 causing it to pivot in a counterclockwise direction about the joint created by the top edge 112 and inner surface 114 of finger 110. The movement of the latch member 100 removes the latching finger 102 from engagement with side R of the remote end 116 of the movable contact arm 50, and permits the contact arm 50 to return to its pre-stressed condition opening contacts 52 and 56.

After tripping, the coil assembly 90 is de-energized, spring 93 returns plunger 92 to its original extended position and banger 94 moves to its original position releasing latch member 100. At this time, the latch member 100 is in a lockout position where latch finger 102 inhibits movable contact 52 from engaging fixed contact 56. One or both latching fingers 102 can act as an active inhibitor to prevent the contacts from touching. Alternatively, the natural bias of movable arms 50 and 70 can be used as a passive inhibitor that prevents the contacts from touching.

To reset the GFCI receptacle so that contacts 52 and 56 are closed and continuity in the phase conductive path is re-established, the reset button 30 is depressed sufficiently to overcome the bias force of return spring 120 and moves the latch member 100 in the direction of arrow A. Depressing the reset button 30 causes the latch finger 102 to contact side L of the movable contact arm 50 and, continued depression of the reset button 30, forces the latch member to overcome the stress force exerted by the arm 50 to cause the reset contact 104 on the arm 50 to close on reset contact 106. Closing the reset contacts activates the operation of the circuit interrupter by, for example simulating a fault, so that plunger 92 moves the banger 94 upwardly striking the latch member 100 which pivots the latch finger 102, while the latch member 100 continues to move in the direction of arrow A. As a result, the latch finger 102 is lifted over side L of the remote end 116 of the movable contact arm 50 onto side R of the remote end of the movable contact arm. Contact arm 50 now returns to its unstressed position, opening contacts 104 and 106, to terminate the activation of the circuit interrupting portion, thereby de-energizing the coil assembly 90.

After the circuit interrupter operation is activated, the coil assembly 90 is de-energized, plunger 92 returns to its original extended position, banger 94 releases the latch member 100, and latch finger 102 is in a reset position. Release of the reset button causes the latching member 100 and movable contact arm 50 to move in the direction of arrow B until contact 52 electrically engages contact 56, as seen in FIG. 2.

Figure 7:
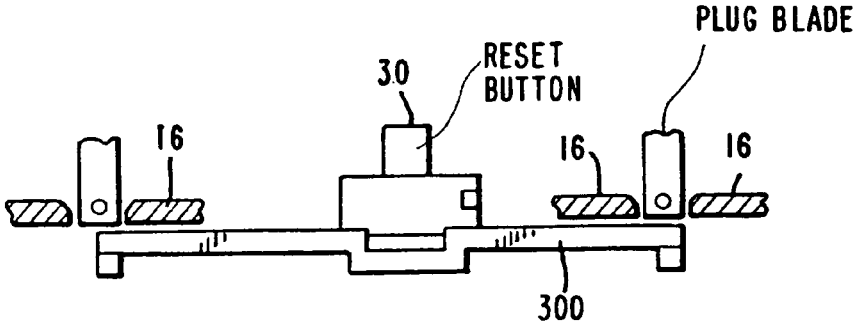
FIG. 7 is a side view of a blocking member in a GFCI device in accordance with the principles of the invention.
Figure 8:
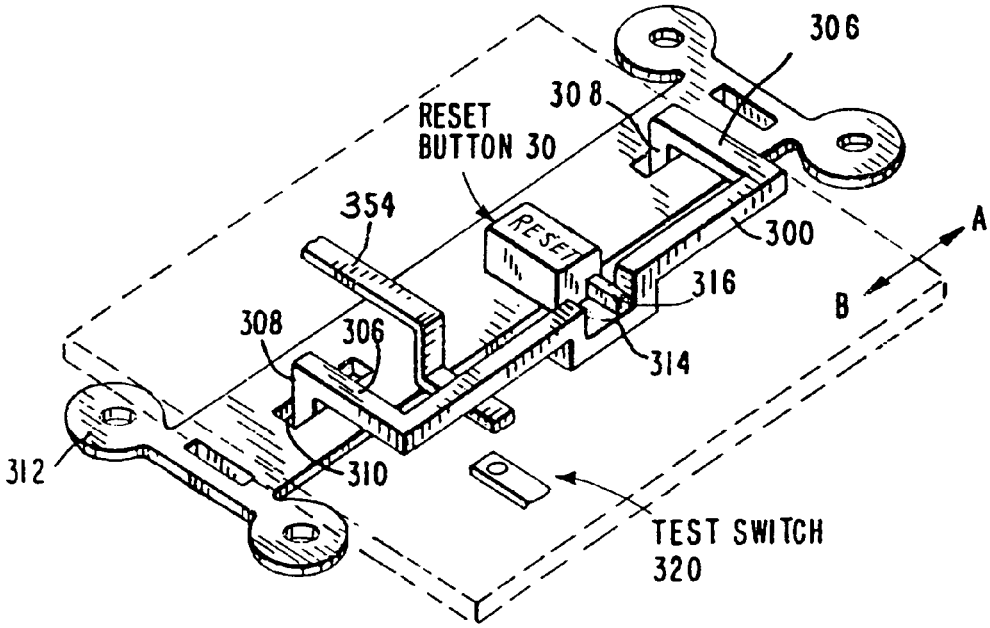
FIG. 8 is a perspective view, partially in section, of a portion of the GFCI device shown in FIG. 1, illustrating the blocking member in a blocking position.

FIG. 7, illustrates a partial side view of the receptacle showing the relationship of the blocking member 300 relative to the reset button 30 and a receptacle opening 20 of each of the two receptacles in the face of the GFCI; and, FIG. 8 is a perspective view, partially in section, of the GFCI illustrating in greater detail the blocking member relative to the reset button and the receptacle openings.

Referring to FIG. 8, the blocking member 300 is located between the housing 12 and the cover portion 16 of the receptacle and is selectively operated to block the plug receiving openings 20 in the face of the receptacle 16 when the GFCI is in its non-conducting state, and allow the prongs of a plug to be inserted into the openings when the GFCI device is in its conducting state.

As illustrated in FIG 8, the U shaped blocking member 300 is located under the cover 16 of the receptacle and supports two end portions 306 each having a downwardly extending end 308 adapted to be slidably and pivotally engaged within cutouts 310 in mounting strap 312. A recess 314 centrally located in the blocking member is positioned to cooperate with finger 316 which projects from the side of the reset button 30. The blocking member can be composed of insulating material such as a non conducting plastic. Located under the blocking member is contact arm 354. The ends 308 of the blocking member 300 are slidably coupled in cutouts 310 in the strap and permit the mounting member to slide laterally along the strap from left, position B, to the right, position A. When the blocking member is at the left, position B, the finger 316 on the reset button is located above the blocking member, not the recess, and, if the reset button is depressed the finger 316 will exert a downward force on the blocking member. When the blocking member is at the right, position A, the finger on the reset button 30 is located above the recess 314 in the blocking member and, if depressed, will enter the recess 314. If the reset button 30 is pressed as the blocking member is moved from position B to position A, the finger 316 will slide along the top of the mounting member and fall into recess 314. The blocking member, in addition to being slidably coupled to the strap 312, is also pivotally coupled to the strap. More specifically, if the reset button 30 is depressed when the blocking member is at the left, position B the finger 316 will contact the top surface of the blocking member and urge it to pivot downward about the blocking ends 308 against the force of a spring, not illustrated and/or contact arm 354. As the blocking member pivots downward, it urges contact arm 354 downward and closes contacts 56, 52 to initiate a test cycle. Obviously, if the reset button is depressed when the blocking member is in position A, the finger 316 will enter the recess 314 and a test cycle will not be initiated. When the blocking member is in position A the receptacle openings are not blocked by the blocking member and a plug can be inserted into the receptacles. When the blocking member is in position B the receptacle openings are blocked by the blocking member and a plug can not be inserted into the receptacles.

In operation, lockout is achieved initially when the blocking member blocks the receptacle openings on a miss-wired or defective unit. When the GFCI device is in its lockout condition, the blocking member is in position B. Referring to FIG. 8, as the reset button is depressed, the finger 316 on the reset button interferes with the top surface of the blocking member causing it to pivot about the ends 308 and move contact arm 354 downward to activate the test cycle. If the GFCI is miss wired or the GFCI has failed, the blocking member will not be moved laterally and the GFCI will remain in its locked out state.

Figure 9:
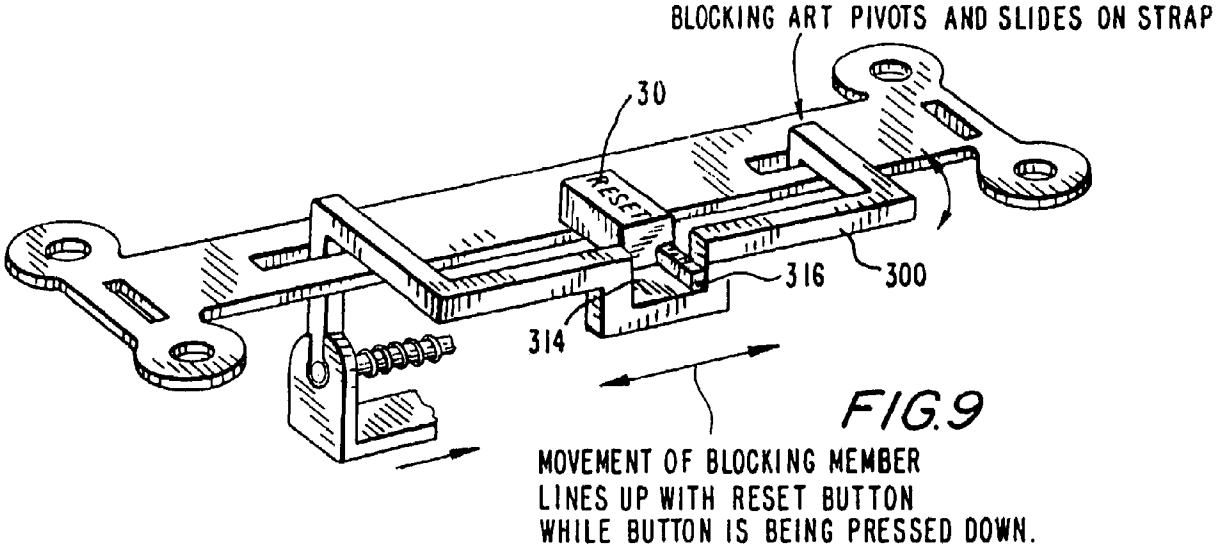
FIG. 9 is a perspective view, partially in section, of a portion of the GFCI device of FIG. 1, illustrating the blocking member in a non blocking position.
Figure 10:
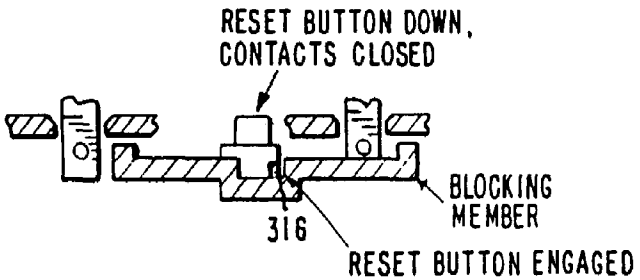

If, however, the GFCI is properly wired and is fully operational, then, when the reset button is pressed down and the test cycle is started by the closing of the test switch 320, the solenoid 90 will be operated to cause the blocking member to move laterally from position B to position A. See FIG. 9. Activation of the solenoid 90 causes the banger to move the blocking member 300 from position B to position A. As the blocking member moves to position A, the recess 314 moves under the finger 316 and the blocking member pivots upward. Continued downward pressure on the reset button allows latching finger 102 (see FIG. 2) to be positioned beneath and contact the end of arm 50. Upon release and, therefore, upward movement of the reset button, latching fingers 102 engage the ends of the arms 50, 70 which causes contacts 56,52 to close and apply power to the downstream contacts. At this time, the reset button is in its down position. See FIG. 10. This causes the blocking member to remain in position A and the receptacle openings are not blocked. It is to be noted that at this time the blocking member is being urged by a spring, not shown, to move to position B but is prevented from doing so by the finger 316 being located within the recess 314.

Figure 11:
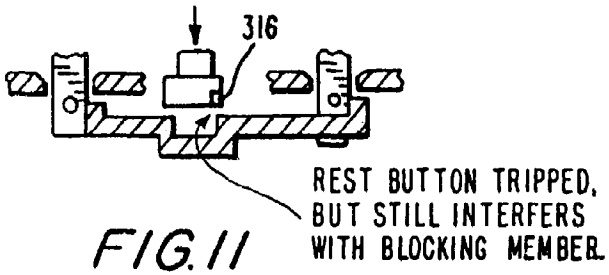
FIGS. 10 and 11 are side elevation views illustrating the positions of the reset button and blocking member when the blocking member is in a blocking and non blocking position.

If the GFCI trips while the blade of a plug is in the receptacle, the reset button will move to its up position out of the recess 314 and the blocking member will be urged to move to position B by the spring. However, the blocking member will not fully block the receptacle openings because the plug blade is still in the receptacle. See FIG. 11. This partially closed position of the blocking member causes an interference between the blocking member and the finger of the reset button. See FIG. 11. If the reset button is depressed at this time, and the circuit in the GFCI is operational, the solenoid will fire and the GFCI will become operational upon release of the reset button. If, however, the GFCI is defective, the solenoid will not fire and the GFCI will not connect the load to the power source.

Although the components used during circuit interrupting and device reset operations as described above are electromechanical in nature, the present application also contemplates using electrical components, such as solid state switches and supporting circuitry, as well as other types of components capable of making and breaking electrical continuity in the conductive path.

While there have been shown and described and pointed out the fundamental features of the invention, it will be understood that various omissions and substitutions and changes of the form and details of the device described and illustrated and in its operation may be made by those skilled in the art, without departing from the spirit of the invention.

What is claimed is:

1. A circuit interrupting device comprising:

a housing;

a phase conductive path and a neutral conductive path each disposed at least partially within said housing between a line side and a load side, said phase conductive path terminating at a first connection capable of being electrically connected to a source of electricity, a second connection capable of conducting electricity to at least one load and a third connection capable of conducting electricity to at least one user accessible load, and said neutral conductive path terminating at a first connection capable of being electrically connected to a source of electricity, a second connection capable of providing a neutral connection to said at least one load and a third connection capable of providing a neutral connection to said at least one user accessible load;

a circuit interrupting portion disposed within said housing comprising a movable arm having contacts thereon adapted to disengage from fixed contacts to cause electrical discontinuity in said phase and neutral conductive paths between said line side and said load side upon the occurrence of a predetermined condition;

a reset portion disposed at least partially within said housing and configured to reestablish electrical continuity in said phase and neutral conductive paths;

wherein said reset portion comprises:

a reset button adapted to assume a first or second position relative to the housing when the circuit interrupting device is in a conducting or non-conducting state; and at least one reset contact which is capable of contacting at least a portion of said phase conductive path to cause said predetermined condition, wherein if said circuit interrupting portion is operational, the circuit interrupting portion is activated to disable said reset lockout portion and facilitate reestablishing electrical continuity in said phase and neutral conductive paths, and wherein if said circuit interrupting portion is non-conducting, said reset lockout portion remains enabled so that reestablishing electrical continuity in said phase and neutral conductive paths is prevented; and blocking means coupled to the reset button and the reset portion to block the third connection from being connected to a user accessible load while the circuit interrupting portion is in a non-conducting state.

2. The circuit interrupting device of claim 1 wherein the blocking means is adapted to assume a first position to allow the third connection to be connected to the user accessible load while the circuit interrupting portion is conducting and a second position to prevent the third connection being connected to the user accessible load while the circuit interrupting portion is non-conducting.

3. The circuit interrupting device of claim 2 wherein the reset button is adapted to assume a first position when the device is conducting and a second position when the device is non-conducting, and wherein the blocking means is coupled to be moved to the first position by the reset portion and retained in that position by the reset button when in its first position.

4. The circuit interrupting device of claim 3 wherein the blocking means is urged to move to its second position when the reset button is moved to its second position.

5. The circuit interrupting device of claim 4 wherein the blocking means is urged to its second position by a spring.

6. The circuit interrupting device of claim 4 wherein the blocking means is of insulating material.

7. The circuit interrupting device of claim 3 wherein the reset button supports a finger projection adapted to engage and retain the blocking means in its first position when the reset button is in its first position.

8. The circuit interrupting device of claim 7 wherein, upon occurrence of the predetermined condition, the reset button is adapted to move to its second position to disengage the finger projection from the blocking means and locate the finger projection above the blocking means.

9. The circuit interrupting device of claim 8 wherein the finger projection, acting thru the blocking means, is adapted to initiate a test cycle when depressed and when the reset button and blocking means are in their second positions.

10. The circuit interrupting device of claim 9 wherein the blocking means is adapted to prevent the reset button being moved to its first position while the blocking means is in its second position.

11. The circuit interrupting device of claim 3 where the blocking means cannot be moved from its second position to its first position if the reset portion is not operative.

* * * * *